United States Patent [19]

Braaten

[11] Patent Number: 4,816,005

[45] Date of Patent: Mar. 28, 1989

[54] SPORTS BRA

[76] Inventor: Renelle Braaten, 700 Third Ave., Havre, Mont. 59501

[21] Appl. No.: 60,326

[22] Filed: Jun. 10, 1987

[51] Int. Cl.[4] ..... A41C 3/02

[52] U.S. Cl. ..... 450/58; 450/66; 450/74; 450/75; 450/76

[58] Field of Search ..... 450/58, 62, 65, 66, 450/67, 69, 74, 75, 76, 85, 2, 31, 34; 2/67

[56] References Cited

U.S. PATENT DOCUMENTS

| | | | |
|---|---|---|---|
| 1,420,248 | 6/1922 | Ray | 450/66 |
| 1,510,428 | 9/1924 | Voliva | 450/58 X |
| 2,390,465 | 12/1945 | Russo | 450/58 |
| 3,066,676 | 12/1962 | Kaupp | 450/58 |
| 3,430,632 | 3/1969 | James et al. | 450/66 X |
| 3,554,190 | 1/1971 | Kaplan | 450/2 X |
| 3,817,255 | 6/1974 | Le Cascio | 450/74 |
| 4,289,137 | 9/1981 | Dell et al. | 450/58 |
| 4,583,544 | 4/1986 | Flanagan et al. | 450/58 |

*Primary Examiner*—Werner H. Schroeder
*Assistant Examiner*—Jeanette E. Chapman
*Attorney, Agent, or Firm*—Thomas R. Vigil

[57] ABSTRACT

The sports bra comprises two front panel sections with each front panel section being a mirror image of the other and including a main body portion and an upwardly extending wide strap forming portion and a rear panel section including a body portion and two upwardly extending wide strap forming portions. The body portion of the rear panel section is attached on each side edge thereof to one of the main body portions of one of the front panel sections and the upper ends of each strap forming portion are attached to the upper end of one of the strap forming portions of one of the front panel sections. The rear panel section includes two elastic strap reinforcing bands which extend from the upper end of one of the strap forming portions angularly downwardly to the opposite side edge of the rear panel section to form cross strap members. The sports bra has arm holes and a neck hole which are defined between the areas of joining of the front and rear panel sections. Securement means are provided at opposing end edges of the mirror image front panel sections for securing the two front panel sections together when the bra is worn. Each of the front panel sections has a plurality of darts with the darts being positioned in such a manner as to form the body section with pouches that extend outwardly from the body when the bra is secured around the body of the wearer.

23 Claims, 2 Drawing Sheets

SPORTS BRA

BACKGROUND OF THE INVENTION

1. Field of the Invention

The present invention relates to a sports bra which is created to provide support, especially for the woman with large breasts, during leisure time activities, such as jogging, horseback riding and aerobics. More particularly, the sports bra is constructed in such a manner as to provide firm support for the breasts and back of the wearer and to avoid irritation commonly experienced by the woman with large breasts during such activities.

2. Description of the Prior Art

Heretofore, various sports bras have been proposed to provide support, by binding the breasts of a woman against the body. Examples of number of such bras are disclosed in the following U.S. Patents:

| U.S. PAT. NO. | PATENTEE |
|---|---|
| 3,628,539 | Fredricks |
| 4,174,717 | Schreiber et al |
| 4,289,137 | Dell et al |
| 4,311,150 | Schreiber et al |
| 4,314,569 | Speno |
| 4,325,378 | Wilkinson |
| 4,444,191 | Harned |
| 4,538,614 | Henderson |
| 4,583,544 | Flanagan et al |

The Fredericks U.S. Pat. No. 3,628,539 discloses a mammary support which comprises a postoperative mammary dressing or support constructed of uniformly distensible material having a back panel and front panels. The panels are detachably connected to one another for facilitating application and removal of the dressing. Each front panel includes a breast cup having an upper section of elliptical profile and a lower section of semielliptical profile arranged and connected to one another and to the detachable panels in a manner which, it is stated, will reduce respiratory restriction and post operative hematoma and seroma formation, while at the same time, exerting a uniform force to maintain artificial implants in position during healing.

The Schreiber et al U.S. Pat. No. 4,174,717 discloses an athletic brassiere which is designed to hold the breasts snugly to the body. A wide elastic rib band and elastic strips which cross in the back hold the brassiere firmly in place. A non-irritating material is used and all seams face the outside. There is no hardware in this brassiere. The cups are not shaped, but are made of an elastic material to pull the breasts in snugly against the body.

The Dell et al U.S. Pat. No. 4,289,137 discloses a sports brassiere which includes a one-piece back, strong under-bust support, and breast cups which are made to limit upward bounce during jogging or similar athletic activities. The breast cups have elastic panels supporting the underside of the breast. The one-piece back is T-shaped, with the shoulder straps and side panels being part of the one-piece back. The garment has front fastening means.

The Schreiber et al U.S. Pat. No. 4,311,150 discloses an athletic brassiere which comprises a wide elastic rib band and elastic straps which cross in back to hold the brassiere firmly in place. The seams of this brassiere all face the outside and a non-irritating material is used in the formation of same. Again, all hardware is eliminated, and the cups are not shaped but are made of elastic material to pull the breasts in snugly against the body. Elastic edging material lines the top of the front and side panels and merges to form straps which crisscross in the back.

The Speno U.S. Pat. No. 4,314,569 discloses a bra for athletic activities. The bra is constructed to have top cups which extend down farther than on conventional bras, putting the seam between the top cups and the under cups below the apex to avoid irritation of the nipples. Side panels at the outer ends of each under cup extend only the height of the under cup, and each top cup extends farther back above the adjacent side panel, to a seam at the rearward edge of the top cup and side panel. All raw edges of seams on the bra are either on the outside or, if inside, are concealed from contact with the skin. The material for the top cups and under cups may be soft and non-stretchable, such as cotton.

The Wilkinson U.S. Pat. No. 4,325,378 discloses a women's sports garment which is in the general form of a brassiere for use when engaged in a physical activity and in particular, jogging. The garment comprises an inner liner and outer breast supporting flaps overfitting the liner, the inner liner and outer flaps being independently displaceable, at least in the area adjacent the breasts, with the flaps being adjustably cinchable. The liner may be provided with breast-engaging pockets in the general form of a brassiere. The liner may also have shoulder straps and an elastic member disposed below the supporting pockets. The two supporting flaps may be connected to the liner behind the breast-engaging pockets. When the flaps are cinched together, an inward pressure, independent of any vertical load caused by the weight of the breasts, is created, thereby preventing excessive movement. Movement of the liner is independent of movement of the supporting flaps.

The Harned U.S. Pat. No. 4,444,191 discloses a comfort garment which characterizes a jogging support for the upper female anatomy and which may assume various forms, such as (1) a vest which includes a non-elastic front panel and elastic straps attached thereto which combine to restrict upward and downward breast movement, a non-elastic back panel, and expandable bottom and side panels which permit stretching action during jogging or like activity; (2) a similar form to that of the vest, where the entire garment is made from an elastic material and/or where the bottom, side and back panels are unitary and expandable, or variations of the preceding; and (3) a continuous wrapped unit serving the same breast movement restricting functions, but maintained on the torso in a halter/strap fashion. The garment may be secured in position on the wearer in a sweater-like relationship through the use of hooks or loop-pile type fastening material ties, and may serve as an undergarment, or as an outer garment.

The Henderson U.S. Pat. No. 4,538,614 discloses an athletic garment for women which includes two front panels, a rear panel, shoulder straps, and connecting means for connecting the front panels together to secure the garment to the wearer. The garment includes various types of elastic material of varying elasticity and spring rates to provide support for the breasts while securing the garment in the vertical direction to the torso of the wearer. In the vicinity of the securing means on the front of the garment, it is relatively inelastic to provide separation of the breasts. The front and rear panels are of a generally planar configuration to their normal disposition and expand to the form of the person wearing the garment to provide support.

The Flanagan et al U.S. Pat. No. 4,583,544 discloses a sports bra. The bra has no cups and seams are avoided. The bra is, essentially, formed as one continuous knitted piece with a two way stretch, and the rear of the bra has a height almost the same as that of the front of the bra.

As will be disclosed in greater detail hereinafter, the sports bra of the present invention differs from the prior art by providing a structure that is particularly configured for use by the woman with large breasts and which is made of a power knit material that provides for stretching of the fabric around the body of the wearer, provides extra wide straps for the garment thus eliminating pressure on the shoulders of the wearer, the extra wide straps incorporating a non-stretch material insert to limit or altogether eliminate up and down movement of the breasts while jogging, and which has criss-crossed stretchable support members across the back of the bra to provide support for the back of the wearer.

SUMMARY OF THE INVENTION

According to the invention there is provided a sports bra comprising: two front panel sections, each front panel section being a mirror image of the other and including a main body portion and an upwardly extending wide strap forming portion; a rear panel section, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said rear panel section including two elastic strap reinforcing bands which extend from the upper end of one of said strap forming portions angularly downwardly to the opposite side edge of the rear panel section and forming cross strap members, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to form the body section with pouches that extend outwardly from the body when the bra is secured around the body of the wearer.

DESCRIPTION OF THE PREFERRED EMBODIMENT

Figure 1:
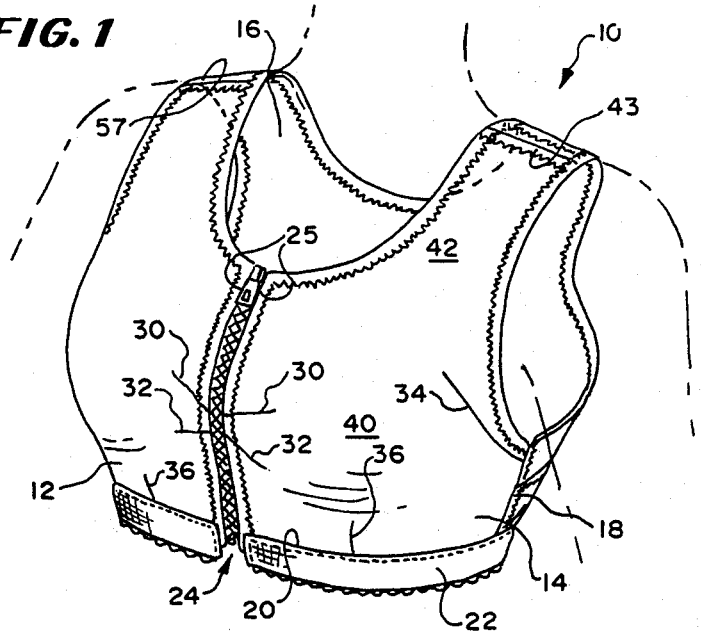
FIG. 1 is a perspective view of the sports bra of the present invention and is illustrated on the torso of a wearer (the wearer being illustrated in phantom).

Referring now to the drawings in greater detail, there is illustrated in FIG. 1 a sports bra 10 constructed according to the teachings of the present invention. As illustrated, the sports bra 10 comprises two mirror-image front panel sections 12 and 14 which are substantially identical to each other. Also, the sports bra 10 has a rear or back panel section 16 which is joined at each lateral end edge 17 thereof to a lateral end edge 17′ of each of the front panel sections 12 and 14 at a side seam 18. The panel sections 12, 14 and 16 are made of a stretch material. With the panel sections 12, 14 and 16 sewn together as illustrated, a lower or bottom edge 20 for the sports bra 10 is defined. Attached to this lower end edge 20, and extending circumferentially about the upper torso, at a level just below that of the breasts of the wearer, is an elastic band 22. This band 22 is elastic only circumferentially around the body of the wearer and is substantially inelastic in the vertical direction. As further illustrated, the two front panel sections 12 and 14 are provided with securement means, such as a zipper 24, along a front center opposing edge 25 of each panel section 12, 14, to join the panel sections 12, 14 together, providing a garment or bra 10 which completely surrounds the upper torso of the female wearer in a manner similar to that in which a regular bra or very short vest would surround the torso, with the elastic band member 22 being positioned just below the level of the breasts and slightly above the end of the wearer's rib cage.

Figure 2:
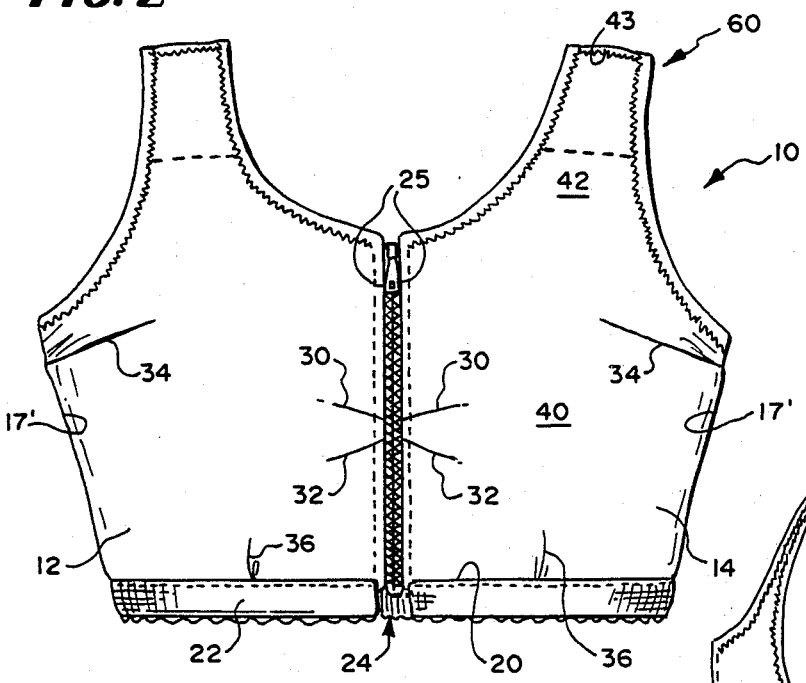
FIG. 2 is a front view of the sports bra constructed in accordance with the teachings of the present invention.

Since each front panel section 12 and 14 is a mirror image of the other, for the sake of brevity, only the front panel section 14 will be described. As shown in FIG. 2, the front panel section 14 is provided with several stitched tapering folds known in the clothing field as darts. Two darts 30 and 32 are provided along the opposing edge 25 of the section 14, at approximately the center thereof. The darts 30, 32 extend angularly away from each other as they extend away from the opposing edge 25 and toward the center of the panel 14 to form a V-shaped area of puckered or pouched material therebetween. An elongate dart 34 extends from the side seam 18 (FIGS. 1 & 3) toward an approximately central position on the front panel section 14. Further, a small dart 36 is provided at an approximately central position along the lower end edge 20 of section 14. This dart 36 extends upwardly or away from the band 22. The front section 14 with the dart structure illustrated defines a body portion 40 for the bra 10, the body portion 40 being so constructed as to receive a breast therein and hold same firmly against the body of the wearer, without binding, to prevent vertical motion of the breast during activity, such as jogging. Also, an upwardly extending strap-forming portion 42 is provided on front panel section 14 and terminates at a free end edge 43 (better illustrated in FIG. 5).

Figure 3:
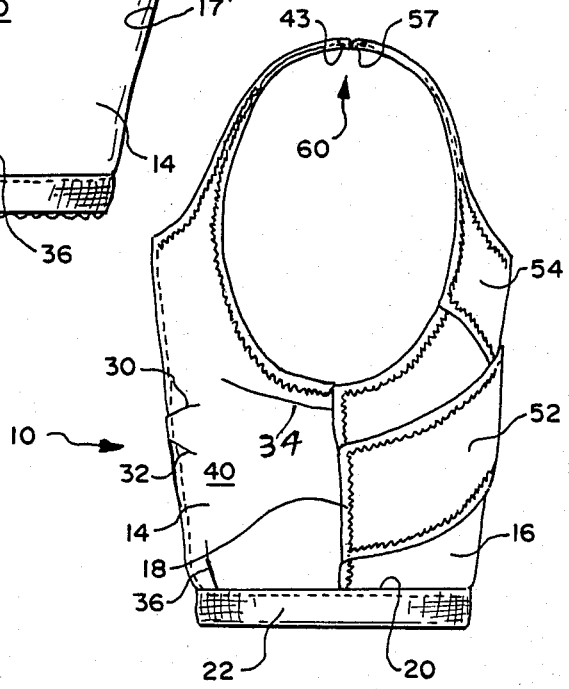
FIG. 3 is a side view of the sports bra constructed according to the teachings of the present invention.

In FIG. 3, there is illustrated a side view of the sports bra 10 of the present invention. As shown, the front panel sections 12, 14, and rear panel section 16 are substantially of the same height with the panel sections 12, 14 being substantially planar, i.e. without cup formations therein. In other words, although the front panels 12, 14 are made to encase the breasts of a female wearer, no cups or other such structure is provided. In essence, the darts 30, 32, 34, and 36, provided within the material of the front panel sections 12, 14, in combination with the stretchable quality of the material, will allow a slight outpouching of the material of the front panel sections 12, 14 to encase the breast mass of the wearer in a flattening manner, to urge the majority of the breast tissue against the sternum or rib cage of the wearer.

Figure 4:
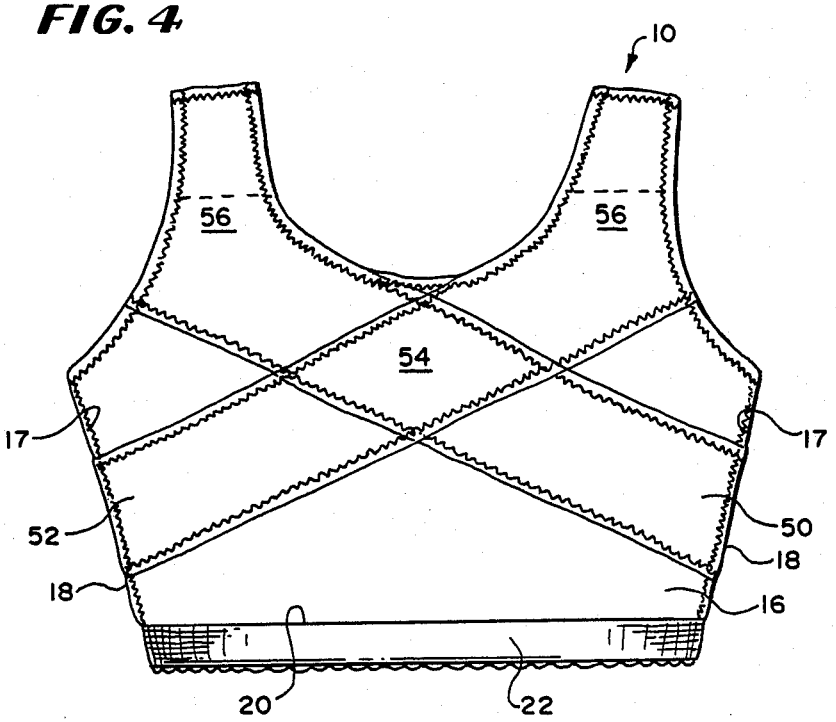
FIG. 4 is a back view of the sports bra constructed according to the teachings of the present invention.

Turning now to FIG. 4, there is illustrated therein a rear or back view of the sports bra 10 constructed in accordance with the teachings of the present invention. As illustrated, the rear or back panel section 16 is formed of a continuous piece of stretchable material, such as a power-knit material, with the stretch of the material extending in the circumferential direction around the body of the wearer. The elastic band member 22 is shown as continuing along the continuous bottom edge 20 of the rear panel section 16. Further, the rear panel section 16 is provided with two cross strip members 50 and 52 which are layered along the outside surface of the back panel 16 and cross each other at 54 forming a diamond shaped configuration 54 at that point. The crossed strip members 50, 52 are each seen to extend from each side seam 18 upwardly across the back panel section 16 and into a strap forming portion 56 on each side of the back panel 16. This criss-cross of sections 50 and 52 is provided to give back support for a wearer by providing a pull upwardly on the front panels, taking the weight of the breasts and distributing it across the back and down into the side seams 18. Further, because the two cross strip members 50 and 52 are placed across the back section 16 in a diagonal manner, the direction in which they stretch is angular relative to the direction of stretch of the rear panel section 16, thus making the rear panel section 16, although stretchable, more supportive by limiting the amount of circumferential stretch available across the shoulder blade area.

Figure 5:
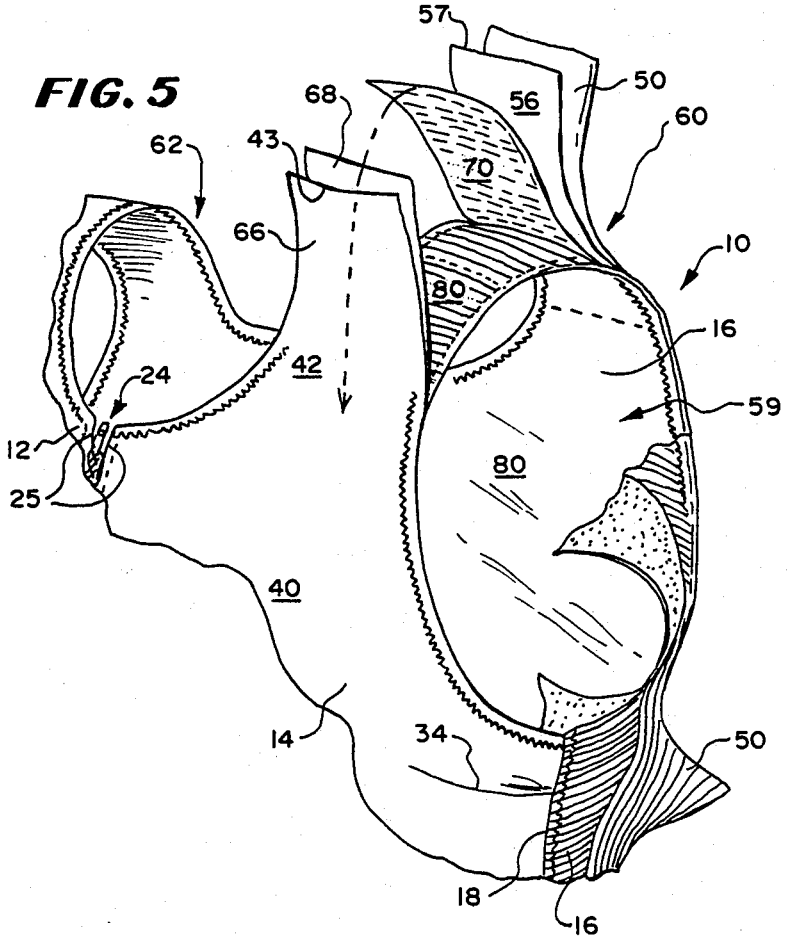
FIG. 5 is a perspective elevational view of the sports bra of FIG. 1 and has portions thereof broken away to illustrate the various layers comprising the sports bra constructed in accordance with the teachings of the present invention.

As best illustrated in FIG. 5, the two strap forming portions 56 of the back panel 16 each have a free end edge 57 which, when the front panels 12, 14 and back panel 16 are joined, joins with the free end portions 43 of the strap forming portions 42 of the front panel sections 12 and 14. Once the front panel sections 12, 14 and rear panel section 16 are joined together along the side seams 18 and free end portions 43, 57 of the strap forming portions 42, 56, a vest-like bra 10 is provided. As illustrated, the sports bra 10 has arm holes 59 and a neck hole 62 which are formed between areas of juncture of the front panel sections 12, 14 with the rear panel section 16.

Such vest-like configuation of the sports bra 10, together with the provision of the front closure means 24 along the two opposing edges 25 of the front panel sections 12 and 14, provides for ease in putting on and removing of the sports bra 10. Further, by the provision of relatively wide strap forming portions, areas or members 42 and 56, straps 60 formed thereby are kept from cutting into the skin of the wearer, as often happens when straps of a bra are narrow and, with the weight they bear when a woman has large breasts, often gouge the skin underlying the straps.

It will be seen that the mirror image front sections 12 and 14 are first of all formed of two outer layers 66 and 68 of a power knit type material with the stretch of the material going in the vertical direction in one layer 66, and the stretch of the material going in the horizontal direction in the other layer 68. Alternatively, layer 68 may stretch vertically and layer 66 may stretch horizontally. Also, to minimize the bounce effect during activity such as jogging, a panel 70 of non-stretch material, approximately seven inches in length, is sewn into each strap 60 and extends equally into the front panel strap forming area 42 and into the rear panel strap forming area 56 from the point at which they are joined. By the provision of this non-stretch material panel 70, the sports bra 10 will not allow for stretching in the area of the shoulder straps 60 and will further keep the wide straps 60 of the bra 10 from digging into the shoulders of the wearer by offering a maximum of anti-bounce effect to the sports bra 10.

Also, the rear and front panel sections 12, 14 and 16 are lined with a very soft stretchable material layer 80, with the layer 80 having all the seams thereof facing outwardly and offset from seams joining the panel section 12, 14 and 16 together, thereby minimizing any seam chafing that could develop against the skin of the wearer. The non-stretch panel 70 extends in the rear strap forming portion 56 between the layer 80 and the layer 56 and in the front strap forming portion 42 between the layers 68 and 80.

Turning now to a study of the formation of the rear panel section 16, the cross strap member 50 is shown to form an outer layer at the side seam 18 with the layer forming the rear panel section 16 forming an inner layer at that point for the rear panel section 16 which also has a continuation of the lining layer 80 of soft material with the inside seams here again all facing away from the body of the wearer and being staggered relative to the seams joining the outer layers together.

Although not shown in the drawings, it is possible to provide a source of ventilation in various positions throughout the sports bra to aid in cooling various areas where moisture collects, such as at the front center of the bra in an area which would be between and below the breasts when worn. Further, the closure means 24 may be provided with some form of underlayment, such as a continuation of the layer 80 of lining material, to prevent chafing which may be caused by contact of the closure means 24 with the skin of the wearer. Accordingly, although not all modifications are disclosed within the specification, the specification should not be considered as limiting with regard to modifications and the scope of the invention should only be considered limited by the accompanying claims.

I claim:

1. A sports bra comprising: two front panel sections, each front panel section being a mirror image of the other and including a substantially planar main body portion and a wide strap forming portion extending upwardly from the main body portion, a rear panel section, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said rear panel section including two elastic strap reinforcing bands which extend from the upper end of one of said strap forming portions angularly downwardly to the opposite side edge of the rear panel section and forming cross strap members, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to allow a slight outpouching of the front panel sections when the bra is secured around the body of the wearer.

2. The sports bra as claimed in claim 1 wherein said front panel sections each comprise first and second layers of a stretchable power knit material.

3. The sports bra of claim 2 wherein said stretch of said first layer is in a vertical direction.

4. The sports bra of claim 2 wherein said stretch of said second layer is in a circumferential direction.

5. The sports bra of claim 1 wherein said rear panel section is made of a single layer of power knit material which stretches in the circumferential direction.

6. The sports bra of claim 1 wherein said shoulder strap forming portions of said front and rear panel sections, when joined together also have a layer of non-stretch material sewn thereto, said layer of non-stretch material extending downwardly from the juncture of said front strap forming member and said rear strap forming member an equal distance into each strap forming member.

7. The sports bra of claim 1 wherein said front and rear panel sections are all lined by a soft, stretchable material.

8. The sports bra of claim 1 wherein said rear panel section has strips of a power knit material extending angularly across the main body portion thereof from a side seam where said rear panel section is attached to one of said front panel sections upwardly and terminates at the area of joining of the strap forming sections of the front and rear panel sections.

9. The sports bra of claim 1 wherein said securement means comprise a zipper.

10. The sports bra of claim 1 wherein said securement means comprise hooks and eyes.

11. The sports bra of claim 1 wherein said securement means comprises a lace and eyes for receiving said lace.

12. The sports bra of claim 1 wherein the body forming portion of each front panel section is provided with at least three darts.

13. The sports bra of claim 12 wherein one of said darts is short and extends upwardly from the bottom edge of the front panel section approximately in the center of the panel section.

14. The sports bra of claim 12 wherein a long dart extends angularly upwardly from a point approximately ⅔ of the way up the side seam into and toward the center of the body forming portion of the front panel section.

15. The sports bra of claim 12 wherein at least two darts are provided at a position which is the approximate center of the opposing edge of the front panel section, each extending angularly away from the other and toward the center of the body forming portion and forming an approximately V shaped area of puckered material therebetween.

16. The sports bra of claim 1 wherein said front panel sections and said rear panel section have a continuous bottom edge with an elastic band secured to said bottom edge and coextensive with said front and rear panel sections, said elastic band being elastic in the circumferential direction and having an elasticity less than that of said panel sections for securing the garment about the torso of the wearer at a level just below the breasts and above the bottom of the ribcage of the wearer.

17. A sports bra comprising: two front panel sections, each front panel section being a mirror image of the other, comprising first and second layers of a stretchable power knit material, and including a main body portion and an upwardly extending wide strap forming portion; a rear panel section, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said rear panel section including two elastic strap reinforcing bands which extend from the upper end of one of said strap forming portions angularly downwardly to the opposite side edge of the rear panel section and forming cross strap members, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to form the body section with pouches that extend outwardly from the body when the bra is secured around the body of the wearer.

18. The sports bra of claim 17 wherein said stretch of said first layer is in a vertical direction.

19. The sports bra of claim 17 wherein said stretch of said second layer is in a circumferential direction.

20. A sports bra comprising: two front panel sections, each front panel section being a mirror image of the other, and including a main body portion and an upwardly extending wide strap forming portion; a rear panel section made of a single layer of power knit material which stretches in the circumferential direction, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said rear panel section including two elastic strap reinforcing bands which extend from the upper end of one of said strap forming portions angularly downwardly to the opposite side edge of the rear panel section and forming cross strap members, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to form the body section with pouches that extend outwardly from the body when the bra is secured around the body of the wearer.

21. A sports bra comprising: two front panel sections, each front panel section being a mirror image of the other, and including a main body portion and an upwardly extending wide strap forming portion; a rear panel section, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said strap forming portions having a layer of non-stretch material sewn thereto, said layer of non-stretch material extending downwardly from the juncture of said front strap forming portion and said rear strap forming portion an equal distance into each strap forming portion, said rear panel section including two elastic strap reinforcing bands which extend from the upper end of one of said strap forming portions angularly downwardly to the opposite side edge of the rear panel section and forming cross strap members, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to form the body section with pouches that extend outwardly from the body when the bra is secured around the body of the wearer.

22. A sports bra comprising: two front panel sections, each front panel section being a mirror image of the other, and including a main body portion and an upwardly extending wide strap forming portion; a rear panel section, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said rear panel section including two elastic strap reinforcing bands which extend from the upper end of one of said strap forming portions angularly downwardly to the opposite side edge of the rear panel section and forming cross strap members, said front and rear panel sections being lined by a soft stretchable material, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to form the body section with pouches that extend outwardly from the body when the bra is secured around the body of the wearer.

23. A sports bra comprising: two front panel sections, each front panel section being a mirror image of the other, and including a main body portion and an upwardly extending wide strap forming portion; a rear panel section, said rear panel section including a body portion and two upwardly extending wide strap forming portions, said body portion being attached on each side edge thereof to one of said main body portions of one of said front panel sections and the upper ends of each strap forming portion being attached to the upper end of one of said strap forming portions of one of said front panel sections, said rear panel section including two elastic strap reinforcing bands which extend from the upper end of one of said strap forming portions angularly downwardly to the opposite side edge of the rear panel section and forming cross strap members, said cross strap members comprising strips of a power knit material, said sports bra having arm holes and a neck hole which are defined between the areas of joining of the front and rear panel sections, securement means at opposing end edges of the mirror image front panel sections for securing the two front panel sections together when the bra is worn, and each of said front panel sections having a plurality of darts, the darts being positioned in such a manner as to form the body section with pouches that extend outwardly from the body when the bra is secured around the body of the wearer.

* * * * *